US005871212A

United States Patent [19]

Lee

[11] Patent Number: 5,871,212

[45] Date of Patent: Feb. 16, 1999

[54] SECTIONAL CHESSBOARD

[76] Inventor: Ki-suk Lee, 309-103 Olympic Apt. Oryun-dong Songpa-gu, Seoul, Rep. of Korea, 138-151

[21] Appl. No.: 941,021

[22] Filed: Sep. 30, 1997

[30] Foreign Application Priority Data

Jun. 16, 1997 [KR] Rep. of Korea ..... 1997-24941

[51] Int. Cl.[6] ..... A63F 3/02

[52] U.S. Cl. ..... 273/283; 273/260; 446/120

[58] Field of Search ..... 273/260, 261, 273/283, 284; 446/120

[56] References Cited

U.S. PATENT DOCUMENTS

| | | | |
|---|---|---|---|
| 841,366 | 1/1907 | Yorke | 273/283 |
| 1,167,394 | 1/1916 | Foster | 273/283 |
| 3,057,624 | 10/1962 | Bassett | 273/283 |
| 3,406,975 | 10/1968 | Berger | 273/283 |
| 4,317,570 | 3/1982 | Brunton | 273/283 X |
| 4,828,268 | 5/1989 | Somerville | 273/283 |
| 5,048,840 | 9/1991 | Johnson, Jr. | 273/283 X |

*Primary Examiner*—William E. Stoll
*Attorney, Agent, or Firm*—Hazel & Thomas, P.C.

[57] ABSTRACT

A sectional chessboard includes a number of sections corresponding to blocks of a chessboard which are formed by injection molding or press work and each section of the chessboard has protrusions and grooves around all sides thereof to be respectively engaged with grooves and protrusions of other sections so that all adjoining sides of each section is jointed together for playing chess as a complete chessboard, wherein it becomes possible to reduce the bulk of the chessboard so that users may conveniently carry them anywhere to play chess and the manufacturing cost may be reduced.

1 Claim, 5 Drawing Sheets

(a)

(b)

SECTIONAL CHESSBOARD

FIELD OF THE INVENTION

This invention relates to a sectional chessboard for playing chess, and more particularly to a, portable sectional chessboard for playing chess, in which each block of the chessboard is formed individually with a synthetic resin plate of a predetermined thickness and jointed together for playing chess or other games, so that it is possible to minimize the size of the chessboard by dividing it into several sections and to carry them conveniently, reducing manufacturing cost thereof. Users may enjoy playing chess regardless of place, and such a chess game is good for developing intelligence of children.

DESCRIPTION OF THE PRIOR ART

In general, conventional chessboards are formed in the shape of a regular square of a certain thickness and size with wood or synthetic resin materials. The chessboard has a predetermined number of blocks (8×8=64 blocks), in which the blocks are colored black or white and the black blocks and white blocks are arranged alternately.

The conventional chessboard has, however, a disadvantage in that it is not convenient to carry since it is too large in its whole size.

The conventional chessboard has another disadvantage in that a bulky additional case is necessary to receive it to carry without damage thereof.

SUMMARY OF THE INVENTION

It is, therefore, an object of the present invention to provide a sectional chessboard which is formed sectionally in a predetermined thickness and size and which is easy to be jointed or disjointed as desired.

It is another object of the present invention to provide a sectional chessboard the size of which is reduced by disjointing it into small sections so that users can carry it anywhere and enjoy playing games regardless of place.

The present invention has been devised with the objects of overcoming such problems. According to the present invention, there is provided a sectional chessboard which is characterized in that a number of sections corresponding to blocks of a chessboard are formed by injection molding or press work and each section of the chessboard has protrusions and grooves around peripherals to be respectively fitted with grooves and protrusions of other sections so that all sides of each section are jointed together by engaging the protrusions and grooves and fixed while playing chess as a complete chessboard.

Therefore, it becomes possible to reduce the size of the chessboard so that users may conveniently carry it anywhere to play chess and the manufacturing cost may be reduced.

DESCRIPTION OF THE DRAWINGS

The present invention will become apparent upon reading the following detailed description of exemplary embodiments and upon reference to the accompanying drawings, in which.

DETAILED DESCRIPTION OF THE INVENTION

Figure 1:
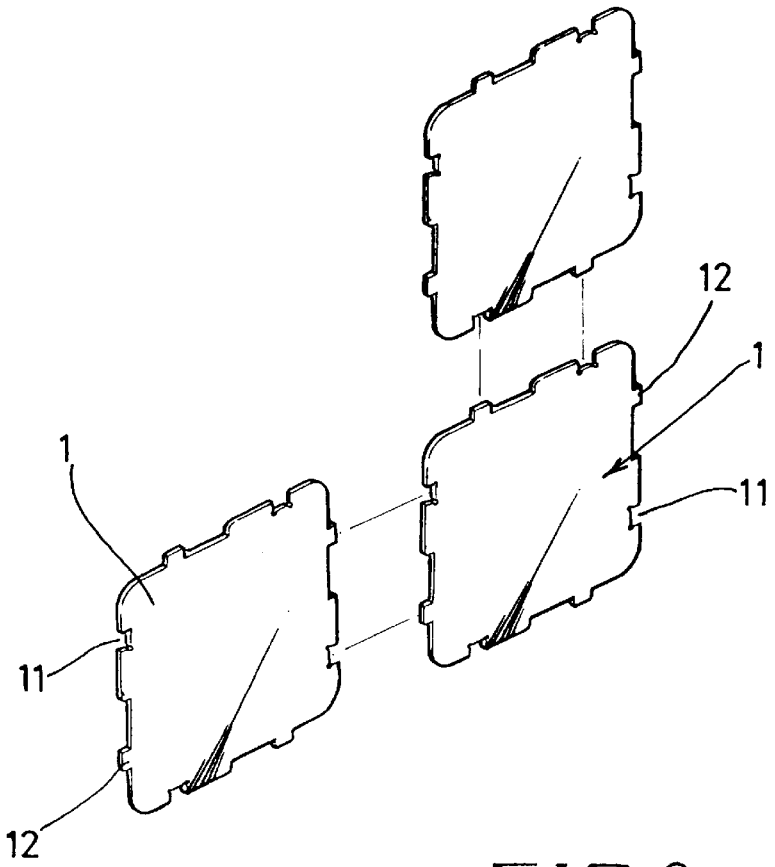
FIG. 1 is a schematical perspective view of a disjointed chessboard according to the present invention.
Figure 2:
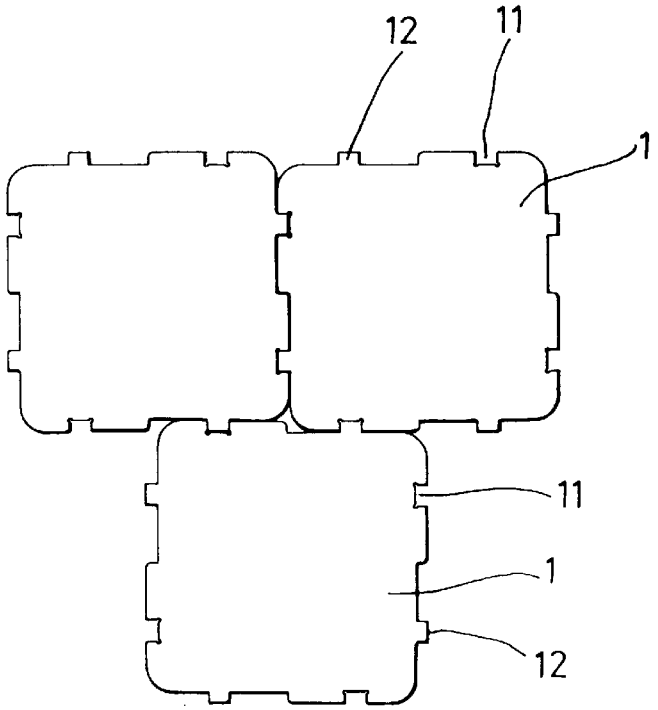
FIG. 2 is a schematical plane view of the chessboard as shown in FIG. 1, in which each section is jointed together to form a complete chessboard.

FIG. 1 and FIG. 2 schematically show sections of a chessboard according to the present invention. In FIG. 1 and FIG. 2, section 1 is formed in the shape of a plane square plate having a predetermined width and thickness by injection molding or press work. The section 1 is made as many as the number of blocks of a chessboard. Especially by using the press work, a plurality of such sections may be made simultaneously from a synthetic resin of a relatively thin thickness (about 1–2 t). Therefore, the productivity and workability for manufacturing such sections are improved, lowering the manufacturing cost.

The section 1 has a plurality of grooves 11 and a plurality of protrusions 12 which are alternately formed along the peripheral thereof. The grooves 11 and the protrusions 12 have complementary shape and size to be fully fitted with other protrusions 12 and grooves 11 of other sections 1 and one or more of the grooves 11 and protrusions 12 are formed on one side of a square section 1.

Figure 3:
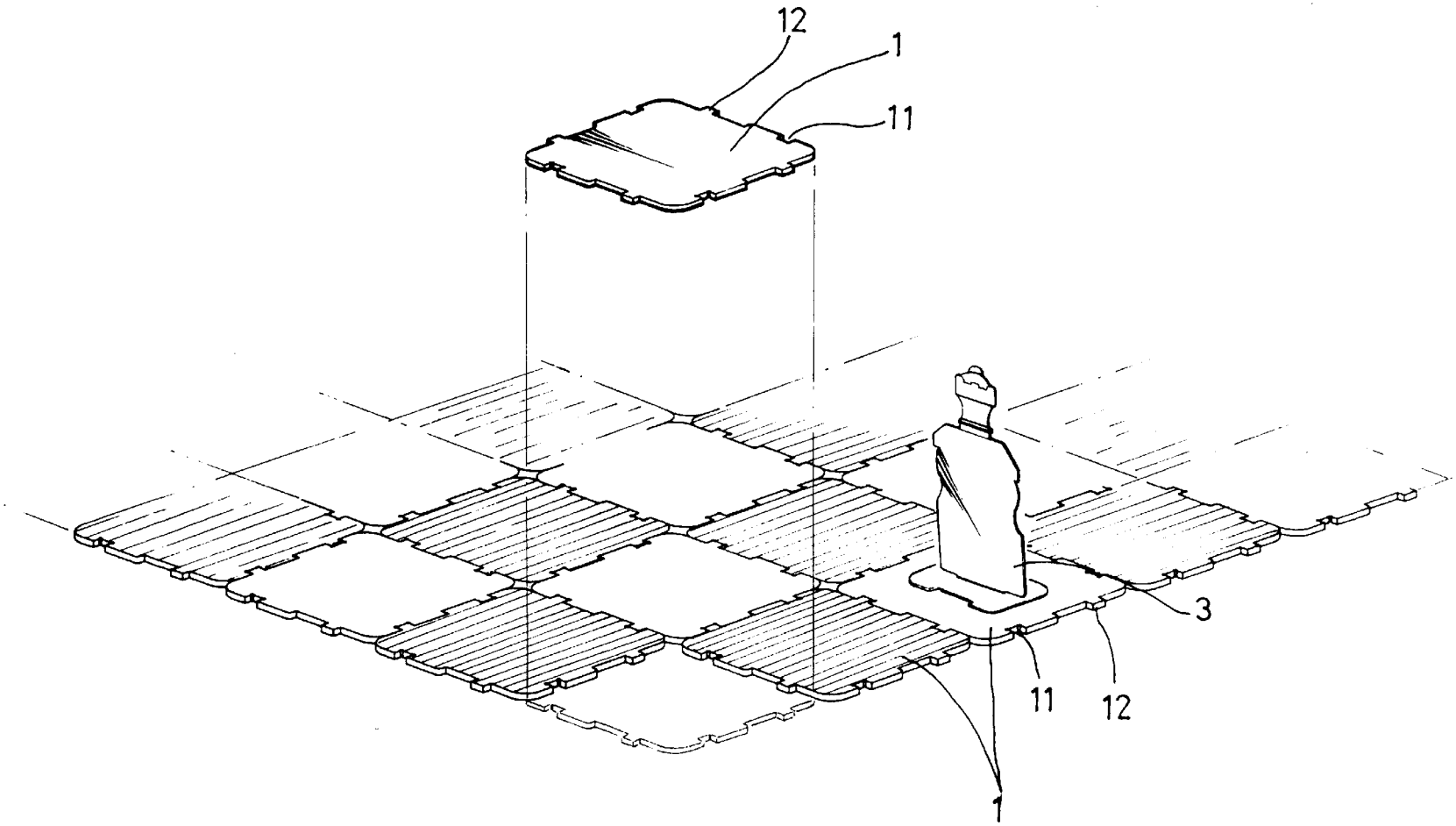
FIG. 3 is a schematical perspective view for explaining playing chess by using the chessboard according to the present invention.

The sections 1 may be arranged linearly in every direction so that respective sides of a section are linked straightly with sides of other sections and such sections 1 are foldable along the straight side lines selectively, as shown in FIG. 1 and FIG. 3.

On the other hand, the sections 1 may also be arranged in such a manner that only a pair of opposite sides of each section is linked continuously with those of other sections and the other pair of opposite sides is linked intermittently in every other line, as shown in FIG. 2. In this case, the sections 1 are foldable along only two side lines of the sections which are arranged in the continuous straight lines.

Half of the sections of a chessboard has a black surface and the other half of the sections has a white surface. These black and white sections are arranged alternately by fitting with other white and black sections to form a complete chessboard 100.

Also, the black and white colors may be printed at both surfaces of each section 1.

Figure 4:
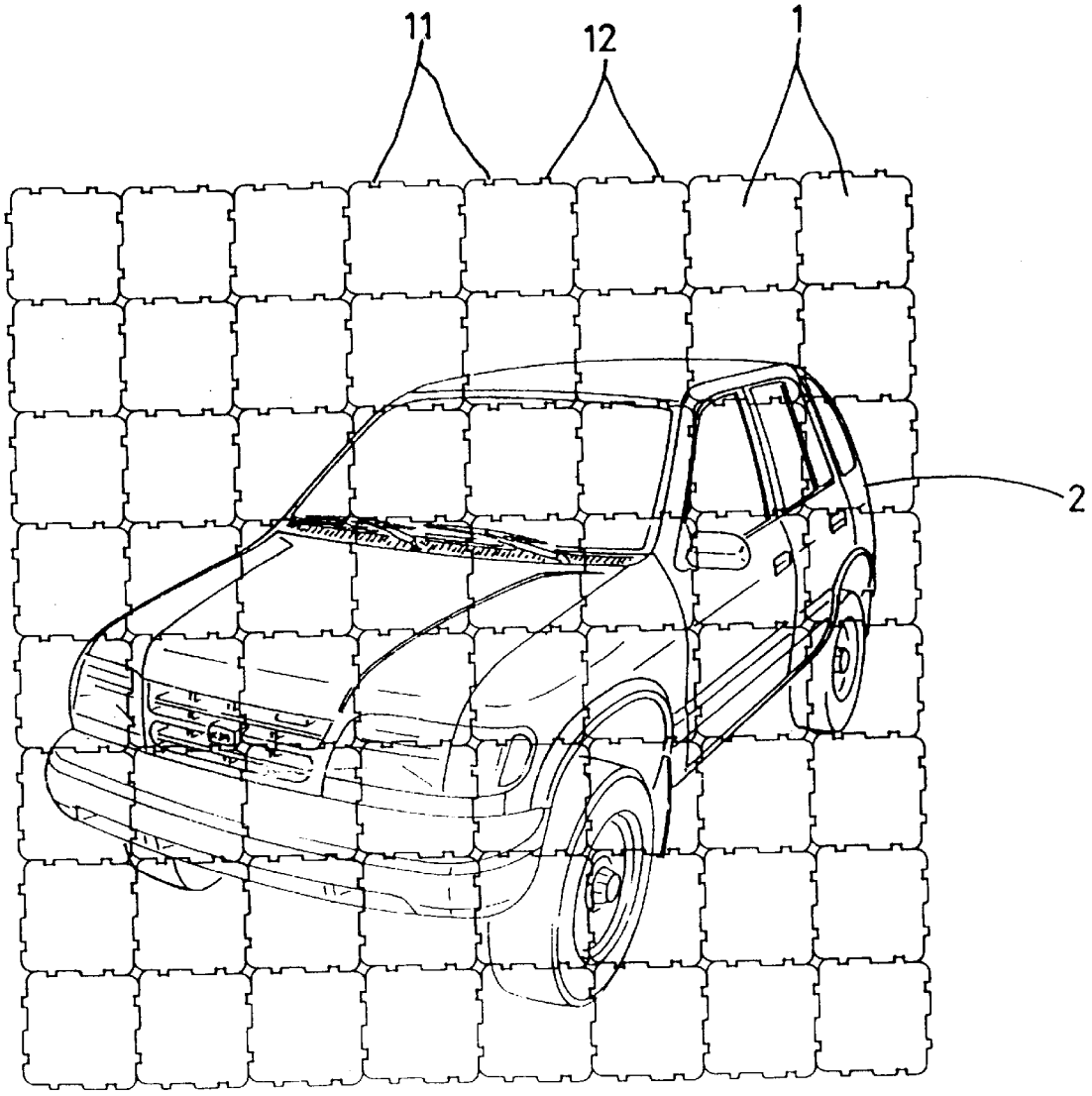
FIG. 4 is a schematical plane view of a chessboard according to the present invention, which may be used for a picture puzzle games.

Now referring to FIG. 4, uncolored surfaces of the sections of a chessboard may be printed a certain picture 2, so that such chessboard sections may be used for picture puzzle games by users, especially by children.

In order to play chess, users may use conventional chessmen which are made three-dimensionally with wood or plastic materials by carving or injection molding. However, as shown in FIG. 3, it is preferable to use sectional chessmen suggested by the inventor in view of manufacturing and carrying.

Figure 5:
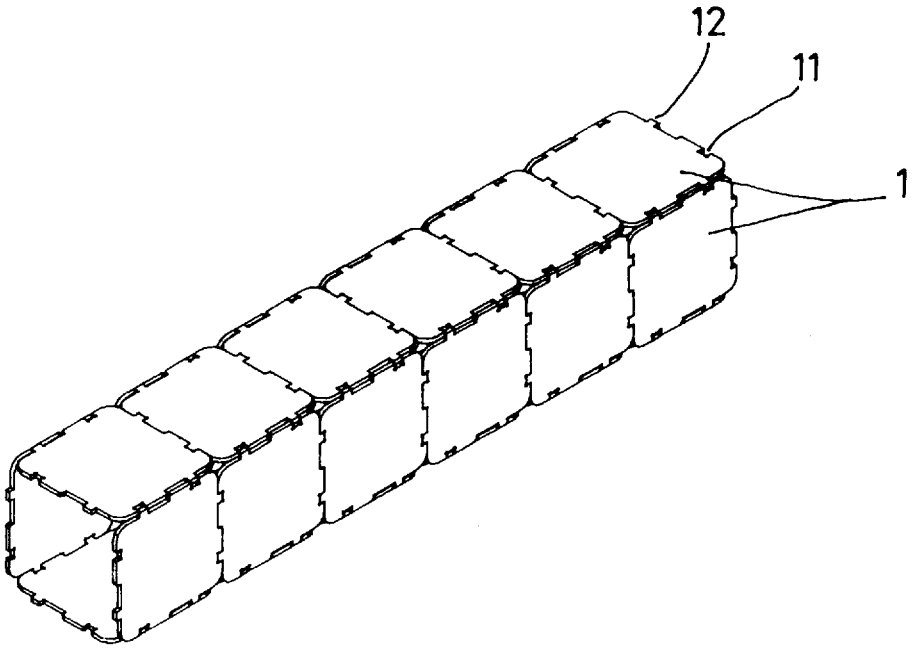
FIGS. 5(*a*) and 5(*b*) are respectively schematical perspective views in which sections of a chessboard are arranged to form a trigonal prism and a square pillar.
Figure 5:
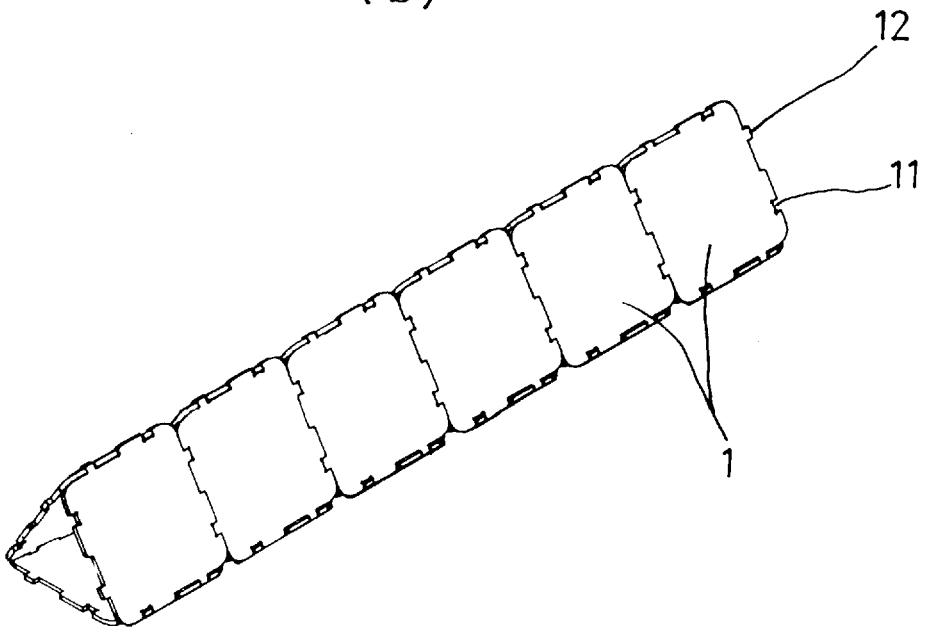

Now referring to FIG. 5(*a*) and FIG. 5(*b*), the chessboard may be used for block games of children by straightly fitting all the sides of the chessboard sections and selectively folding linear edge lines of the fitted sides of the sections in the shape of a trigonal prism, a square pillar, and the like.

Figure 6:
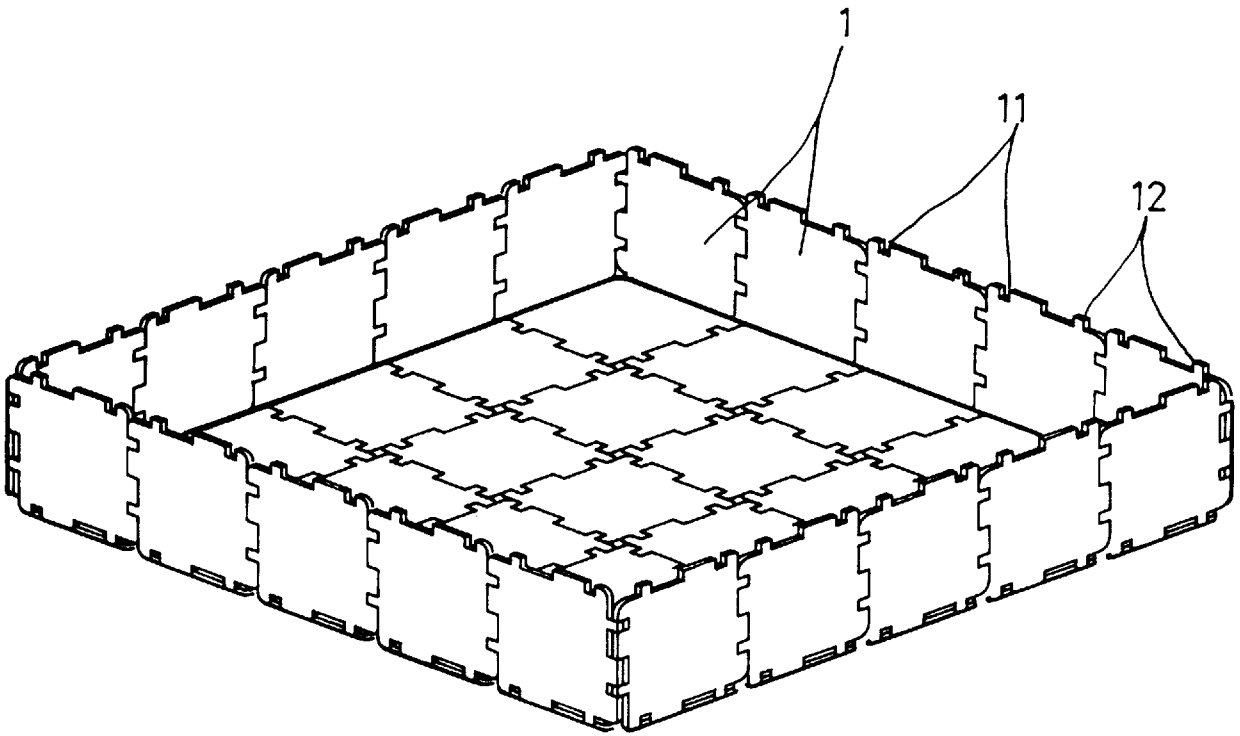
FIG. 6 is a schematical perspective view, in which sections of a chessboard are arranged to form a box.

Also, if the chessboard sections 1 are fitted linearly in every direction and folded to form a box, as shown in FIG. 6, the chessboard may serve as a box in which to put trivial things.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A sectional chessboard comprising a number of sections corresponding to blocks of a chessboard which are formed by injection molding or press work, wherein each section of said chessboard has protrusions and grooves around all sides thereof to be respectively fitted with grooves and protrusions of other sections so that all adjoining sides of each section are jointed together by engaging said grooves and protrusions, and wherein each of said sections has a black surface and a white surface.

* * * * *